United States Patent [19]

Shemitz et al.

[11] Patent Number: 4,924,366

[45] Date of Patent: May 8, 1990

[54] UNIVERSAL MODULAR LIGHTING SYSTEM

[75] Inventors: Sylvan R. Shemitz, Woodbridge; James A. Melling, New Haven, both of Conn.

[73] Assignee: Sylvan R. Shemitz Associates, Inc., West Haven, Conn.

[21] Appl. No.: 319,997

[22] Filed: Mar. 7, 1989

[51] Int. Cl.[5] ..... F21V 21/00

[52] U.S. Cl. ..... 362/249; D26/72; D26/93; 362/147; 362/410

[58] Field of Search ..... 362/134, 238, 239, 249, 362/250, 252, 410, 431, 226, 147, 153; D26/72, 81, 84, 87, 90, 92, 93, 110

[56] References Cited

U.S. PATENT DOCUMENTS 3,509,334 4/1970 Michailov ..... 362/250

4,220,981 9/1980 Koether ..... 362/238 X

*Primary Examiner*—Stephen F. Husar

*Attorney, Agent, or Firm*—Doreen F. Shulman

[57] ABSTRACT

A device which will maximize the versatility of lighting configurations using lighting modules. The device includes a universal mounting system with a base, elongated stems, and at least one mounting frame, that in combination with one or more lighting modules can be used as a floor, ground or ceiling lighting fixture.

3 Claims, 1 Drawing Sheet

UNIVERSAL MODULAR LIGHTING SYSTEM

BACKGROUND OF THE INVENTION

This invention relates to a device in which lighting modules are combined with a universal mounting system for use as either a floor, ground or ceiling lighting fixture.

Lighting modules that are adaptable for direct mounting to a wall, partition or ceiling are well known. However, such applications restrict the available variety of possible lighting configurations. Therefore, there exists a need in the art for a lighting system which will maximize the versatility of lighting configurations using lighting modules.

SUMMARY OF THE INVENTION

This invention provides a universal mounting system with a base, elongated stems, and at least one mounting frame, that in combination with one or more lighting modules can be used as either a floor, ground or ceiling lighting fixture. This lighting system allows lighting modules to be used in a variety of lighting configurations other than conventional direct mounting to a wall, partition or ceiling.

It is an object of this invention to provide a lighting system which will maximize the versatility of lighting configurations using lighting modules.

DETAILED DESCRIPTION OF THE PREFERRED EMBODIMENT

Figure 1:
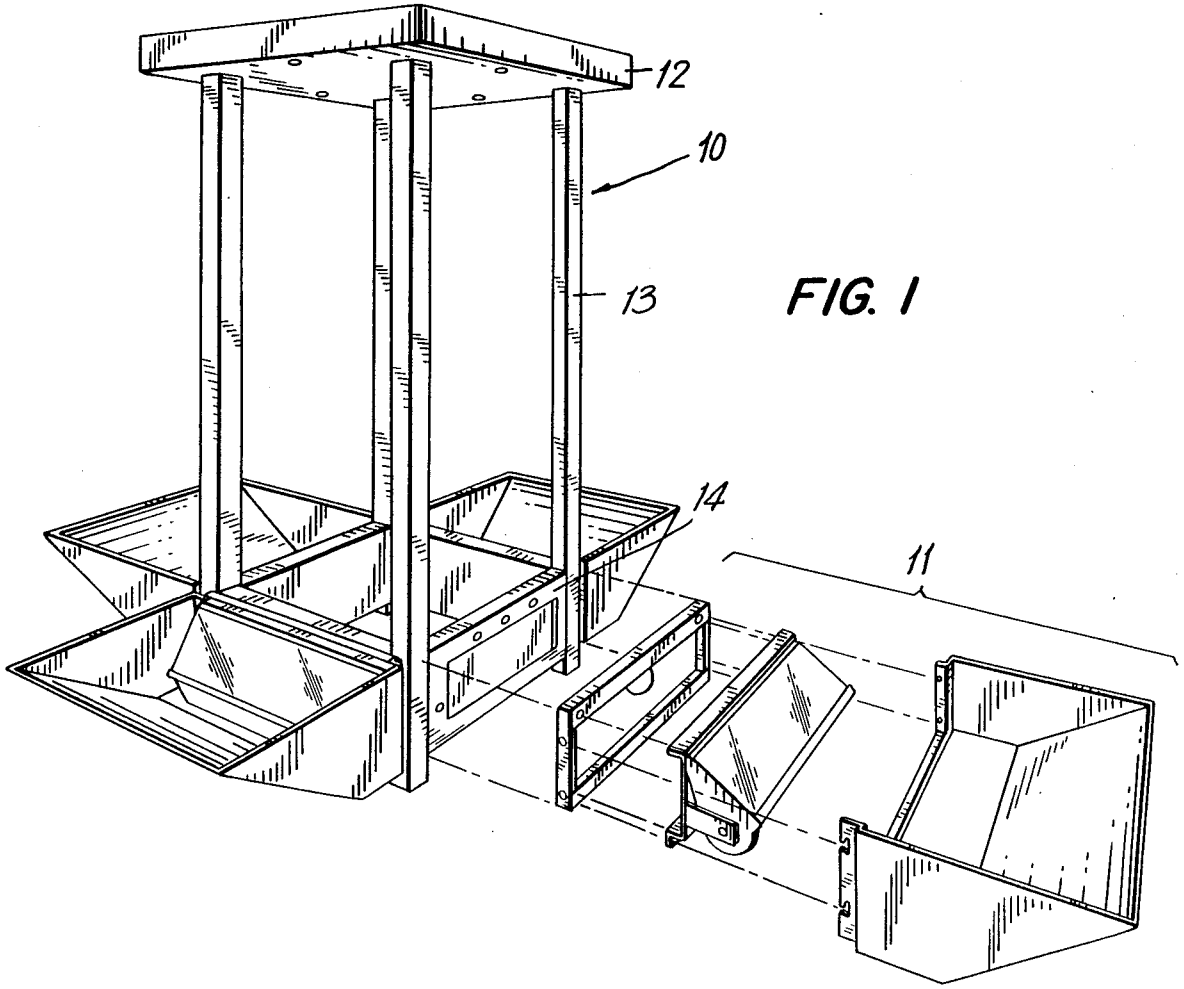
FIG. 1 is a perspective and exploded view of a preferred embodiment of this invention.

The universal modular lighting system as shown in FIG. 1 comprises a universal mounting system 10 and one or more lighting modules 11. The universal mounting system 10 of this invention consists of a base 12, elongated stems 13 and one or more mounting frames 14. One end of each of the elongated stems 13 is attached to the base 12. The other end of each of the elongated stems 13 is attached to one or more mounting frames 14. A lighting module 11 may be attached to any one of mounting frames 14.

The structural versatility of this invention allows lighting modules 11 to be adapted to a variety of lighting configurations. The base 12 can either be mounted on the ceiling or rest on the floor or ground, and the mounting frame 14 and lighting module 11 can be oriented accordingly. In addition, the universal modular lighting system can be used with single, double, triple, quadruple, etc. lighting modules 11 by using appropriate quantities of elongated stems 13 and mounting frames 14.

In addition, although depicted in FIG. 1 with a particular lighting module 11, practically any lighting module can be adapted for use with the universal modular lighting system. For example, the lighting modules of United States design patent application serial numbers 36,843, 36,844, 36,845, 47,457, 47,707, 47,708, 47,924 and 48,061 can be adapted for use with this invention. Also, the lighting module may incorporate special features such as the "rotatable glareshield" of U.S. Pat. No. 4,796,169 (Jan. 3, 1989).

It will be apparent to those skilled in the art that the invention described herein can be practiced by other than the embodiments described above, which are presented for the purpose of illustration and not of limitation, and the present invention is limited only by the claims which follow.

We claim:

1. A universal modular lighting system comprising:

(a) a universal mounting system further comprising:

(1) at least one substantially rectangular mounting frame, having longitudinal sides and a face;

(2) a substantially planar base;

(3) at least two elongated stems, each with one end attached to the base and another end attached to at least one of the longitudinal sides of the mounting frame; and (b) at least one lighting module, attached to the mounting frame face.

2. The universal modular lighting system of claim 1 in which the base is adapted for mounting to a ceiling.

3. The universal modular lighting system of claim 1 in which the base is adapted for resting on a floor or the ground.

* * * * *